US009540756B2

(12) United States Patent
Janke et al.

(10) Patent No.: US 9,540,756 B2
(45) Date of Patent: Jan. 10, 2017

(54) LAUNDRY TREATING APPLIANCE AND METHOD OF FILLING A LAUNDRY TREATING APPLIANCE WITH LIQUID

(71) Applicant: Whirlpool Corporation, Benton Harbor, MI (US)

(72) Inventors: Brian P. Janke, Saint Joseph, MI (US); Stephen L. Keres, Watervliet, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 410 days.

(21) Appl. No.: 14/051,502

(22) Filed: Oct. 11, 2013

(65) Prior Publication Data

US 2015/0101668 A1 Apr. 16, 2015

(51) Int. Cl.

| | |
|---|---|
| ***D06F 35/00*** | (2006.01) |
| ***D06F 39/08*** | (2006.01) |
| ***D06F 33/02*** | (2006.01) |

(52) U.S. Cl.

CPC ..... *D06F 39/088* (2013.01); *D06F 33/02* (2013.01); *D06F 35/006* (2013.01); *D06F 39/087* (2013.01); *D06F 2202/065* (2013.01); *D06F 2202/085* (2013.01); *D06F 2202/10* (2013.01); *D06F 2202/12* (2013.01); *D06F 2204/065* (2013.01); *D06F 2204/086* (2013.01); *Y10T 137/0318* (2015.04)

(58) Field of Classification Search

CPC ..... D06F 33/02; D06F 39/087; D06F 39/088; D06F 2202/10; D06F 2202/12; D06F 2202/085;D06F 2204/065; D06F 2204/086; D06F 35/006

See application file for complete search history.

(56) References Cited

U.S. PATENT DOCUMENTS

| | | | | |
|---|---|---|---|---|
| 4,741,182 | A | 5/1988 | Didier et al. | |
| 5,259,217 | A * | 11/1993 | Civanelli | D06F 39/003 68/12.02 |
| 5,669,095 | A | 9/1997 | Dausch et al. | |
| 5,768,728 | A * | 6/1998 | Harwood | D06F 39/003 68/12.04 |
| 6,505,369 | B1 | 1/2003 | Weinmann | |
| 7,591,038 | B2 | 9/2009 | Murray et al. | |
| 2003/0041390 | A1 * | 3/2003 | Kim | D06F 39/003 8/158 |

(Continued)

FOREIGN PATENT DOCUMENTS

| | | |
|---|---|---|
| DE | 4204046 A1 | 8/1993 |
| DE | 4431846 A1 | 3/1996 |

(Continued)

OTHER PUBLICATIONS

German Search Report for Counterpart DE102014113356.0, dated Mar. 16, 2015.

*Primary Examiner* — Joseph L Perrin

(57) ABSTRACT

A laundry treating appliance having a tub, a drum located within the tub and at least partially defining a treating chamber in which laundry may be received for treatment according to an automatic cycle of operation and a liquid supply system for introducing liquid thereto and a method for filling the laundry treating appliance including supplying liquid, determining a load inertia value and stopping the supply of liquid based thereon.

19 Claims, 4 Drawing Sheets

(56) References Cited

U.S. PATENT DOCUMENTS

| | | | | |
|---|---|---|---|---|
| 2008/0028801 | A1* | 2/2008 | Czyzewski | D06F 35/006 68/12.05 |
| 2008/0189875 | A1* | 8/2008 | Czyzewski | D06F 35/006 8/159 |
| 2010/0011514 | A1* | 1/2010 | Park | D06F 33/02 8/159 |
| 2013/0152311 | A1 | 6/2013 | Janke et al. | |
| 2013/0185872 | A1* | 7/2013 | Chanda | D06F 13/06 8/137 |
| 2014/0250607 | A1* | 9/2014 | Favaro | D06F 35/006 8/137 |
| 2014/0326067 | A1* | 11/2014 | Chanda | G01N 9/00 73/32 R |
| 2015/0354122 | A1* | 12/2015 | Kwon | D06F 29/02 8/137 |

FOREIGN PATENT DOCUMENTS

| | | | |
|---|---|---|---|
| DE | 102012111147 | A1 | 7/2013 |
| DE | 102014109650 | A1 | 2/2015 |
| WO | 2008026942 | A1 | 3/2008 |

* cited by examiner

LAUNDRY TREATING APPLIANCE AND METHOD OF FILLING A LAUNDRY TREATING APPLIANCE WITH LIQUID

BACKGROUND

Laundry treating appliances, such as clothes washers, refreshers, and non-aqueous systems, may have a configuration based on a rotating drum that defines a treating chamber in which laundry items are placed for treating according to one or more cycles of operation. The laundry treating appliance may have a controller that implements the cycles of operation having one or more operating parameters. The controller may control a supply of liquid into the drum according to one of the cycles of operation; however, it is difficult to accurately estimate the correct amount of water to put into the drum. Over estimation results in wasted water and under estimation results in poor wash performance.

BRIEF SUMMARY

In one aspect, an embodiment of the invention relates to a method of filling a laundry treating appliance with liquid where the laundry treating appliance includes a tub, a drum located within the tub and at least partially defining a treating chamber in which laundry may be received for treatment according to an automatic cycle of operation, and a liquid supply system for introducing liquid into one of the drum and tub including supplying liquid from the liquid supply system to wet a laundry load located within the drum, repeatedly determining a load inertia value while wetting the laundry load to define a set of load inertia values, determining a rate of change of the load inertia values, and stopping the supply of liquid when the determined rate of change satisfies a predetermined threshold.

In another aspect, an embodiment of the invention relates to a laundry treating appliance having a tub, a drum located within the tub, a liquid supply system for introducing liquid into one of the drum and tub, a motor drivingly coupled with the drum for rotating the drum, and a controller operably coupled with the liquid supply system to supply liquid from the liquid supply system to wet a laundry load located within the drum and configured to repeatedly determine a load inertia while wetting the laundry load, determine a rate of change of the repeatedly determined load inertia, and stop the supply of liquid when the determined rate of change satisfies a predetermined threshold.

In yet another aspect, an embodiment of the invention relates to a method of filling a laundry treating appliance with liquid where the laundry treating appliance includes a tub, a drum located within the tub and at least partially defining a treating chamber in which laundry may be received for treatment according to an automatic cycle of operation, and a liquid supply system for introducing liquid into one of the drum and tub, including determining a dry inertia value of a dry laundry load within the drum and supplying an amount of liquid from the liquid supply system based on the determined load inertia of the dry load to wet the laundry load.

DESCRIPTION OF EMBODIMENTS OF THE INVENTION

Figure 1:
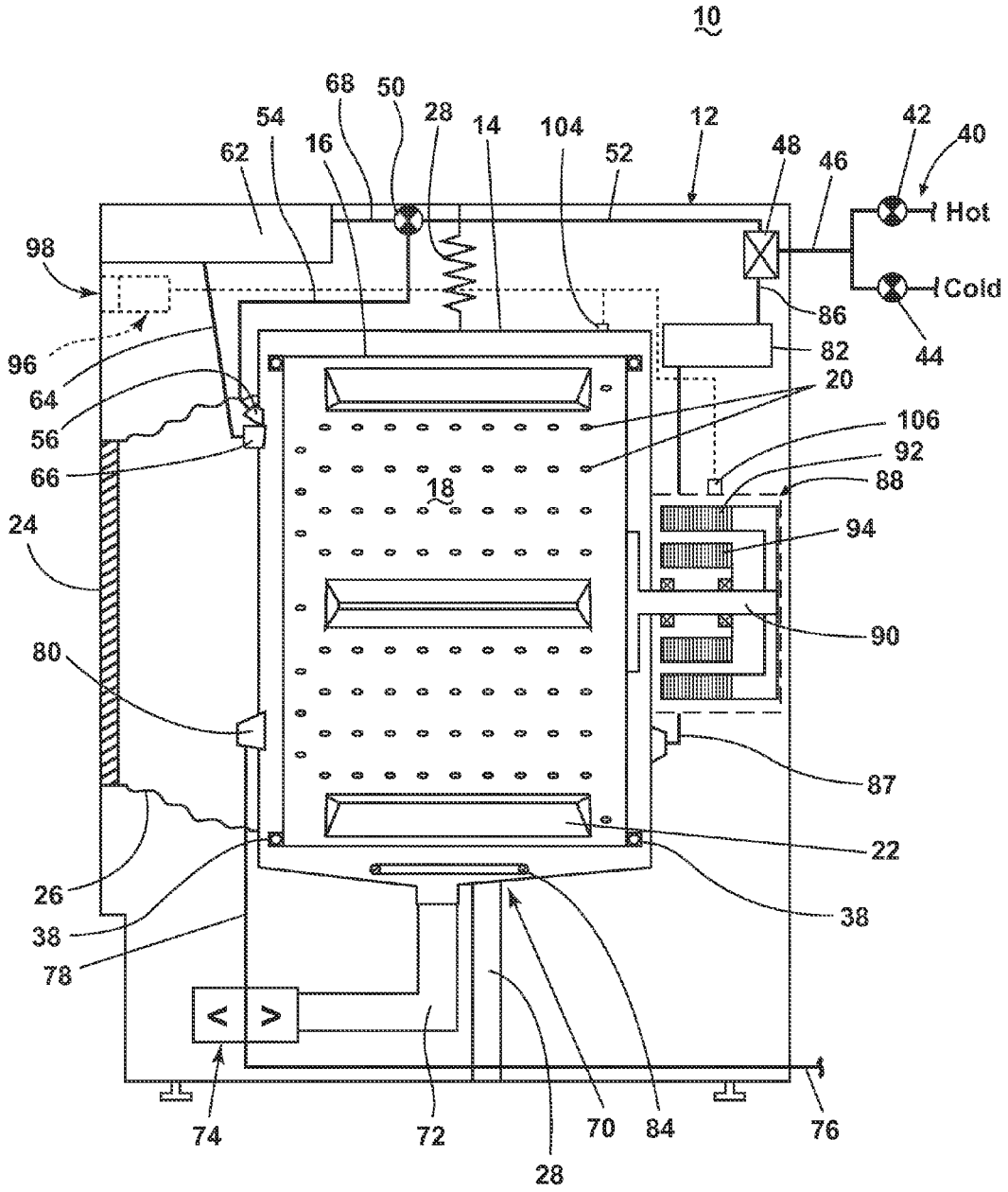
FIG. 1 is a schematic view of a laundry treating appliance in the form of a washing machine according to an embodiment of the invention.

FIG. 1 is a schematic view of a laundry treating appliance according to an embodiment of the invention. The laundry treating appliance may be any appliance which performs a cycle of operation to clean or otherwise treat items placed in a container therein, non-limiting examples of which include a horizontal or vertical axis clothes washer; a combination washing machine and dryer; a dispensing dryer; a tumbling or stationary refreshing/revitalizing machine; an extractor; a non-aqueous washing apparatus; and a revitalizing machine.

As used herein, the term "vertical-axis" washing machine refers to a washing machine having a rotatable drum that rotates about a generally vertical axis relative to a surface that supports the washing machine. However, the rotational axis need not be perfectly vertical to the surface. The drum may rotate about an axis inclined relative to the vertical axis, with fifteen degrees of inclination being one example of the inclination. Similar to the vertical axis washing machine, the term "horizontal-axis" washing machine refers to a washing machine having a rotatable drum that rotates about a generally horizontal axis relative to a surface that supports the washing machine. The drum may rotate about the axis inclined relative to the horizontal axis, with fifteen degrees of inclination being one example of the inclination.

The laundry treating appliance of FIG. 1 is illustrated as a horizontal-axis washing machine 10, which may include a structural support system including a cabinet 12, which defines a housing within which a laundry holding system resides. The cabinet 12 may be a housing having a chassis and/or a frame, defining an interior enclosing components typically found in a conventional washing machine, such as motors, pumps, fluid lines, controls, sensors, transducers, and the like. Such components will not be described further herein except as necessary for a complete understanding of the invention.

The laundry holding system includes a tub 14 supported within the cabinet 12 by a suitable suspension system and a rotatable container or drum 16 provided within the tub 14, the drum 16 defines at least a portion of a laundry treating chamber 18 for receiving a laundry load for treatment. The drum 16 may include a plurality of perforations 20 such that liquid may flow between the tub 14 and the drum 16 through the perforations 20. A plurality of baffles 22 may be disposed on an inner surface of the drum 16 to lift the laundry load received in the treating chamber 18 while the drum 16 rotates. It may also be within the scope of the invention for the laundry holding system to include only a tub with the tub defining the laundry treating chamber.

The laundry holding system may further include a door 24 which may be movably mounted to the cabinet 12 to selectively close both the tub 14 and the drum 16. A bellows 26 may couple an open face of the tub 14 with the cabinet 12, with the door 24 sealing against the bellows 26 when the door 24 closes the tub 14.

The washing machine 10 may further include a suspension system 28 for dynamically suspending the laundry holding system within the structural support system.

The washing machine 10 may also include at least one balance ring 38 containing a balancing material moveable within the balance ring 38 to counterbalance an imbalance that may be caused by laundry in the treating chamber 18 during rotation of the drum 16. More specifically, the balance ring 38 may be coupled with the rotating drum 16 and configured to compensate for a dynamic imbalance during rotation of the rotatable drum 16. The balance ring 38 may extend circumferentially around a periphery of the drum 16 and may be located at any desired location along an axis of rotation of the drum 16. When multiple balance rings 38 are present, they may be equally spaced along the axis of rotation of the drum 16. For example, in the illustrated example a plurality of balance rings 38 are included in the washing machine 10 and the plurality of balance rings 38 are operably coupled with opposite ends of the rotatable drum 16.

The washing machine 10 may further include a liquid supply system for supplying water to the tub 14 and/or the drum 16 of the washing machine 10 for use in treating laundry during a cycle of operation. The liquid supply system may include a source of water, such as a household water supply 40, which may include separate valves 42 and 44 for controlling the flow of hot and cold water, respectively. Water may be supplied through an inlet conduit 46 directly to the tub 14 by controlling first and second diverter mechanisms 48 and 50, respectively. The diverter mechanisms 48, 50 may be a diverter valve having two outlets such that the diverter mechanisms 48, 50 may selectively direct a flow of liquid to one or both of two flow paths. Water from the household water supply 40 may flow through the inlet conduit 46 to the first diverter mechanism 48 which may direct the flow of liquid to a supply conduit 52. The second diverter mechanism 50 on the supply conduit 52 may direct the flow of liquid to a tub outlet conduit 54 which may be provided with a spray nozzle 56 configured to spray the flow of liquid into the tub 14. In this manner, water from the household water supply 40 may be supplied directly to the tub 14.

The washing machine 10 may also be provided with a dispensing system for dispensing treating chemistry to the treating chamber 18 for use in treating the laundry according to a cycle of operation. The dispensing system may include a dispenser 62 which may be a single use dispenser, a bulk dispenser or a combination of a single use and bulk dispenser.

Regardless of the type of dispenser used, the dispenser 62 may be configured to dispense a treating chemistry directly to the tub 14 or mixed with water from the liquid supply system through a dispensing outlet conduit 64. The dispensing outlet conduit 64 may include a dispensing nozzle 66 configured to dispense the treating chemistry into the tub 14 in a desired pattern and under a desired amount of pressure. For example, the dispensing nozzle 66 may be configured to dispense a flow or stream of treating chemistry into the tub 14 by gravity, i.e. a non-pressurized stream. Water may be supplied to the dispenser 62 from the supply conduit 52 by directing the diverter mechanism 50 to direct the flow of water to a dispensing supply conduit 68.

Non-limiting examples of treating chemistries that may be dispensed by the dispensing system during a cycle of operation include one or more of the following: water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

The washing machine 10 may also include a recirculation and drain system for recirculating liquid within the laundry holding system and draining liquid from the washing machine 10. Liquid supplied to the tub 14 through tub outlet conduit 54 and/or the dispensing supply conduit 68 typically enters a space between the tub 14 and the drum 16 and may flow by gravity to a sump 70 formed in part by a lower portion of the tub 14. The sump 70 may also be formed by a sump conduit 72 that may fluidly couple the lower portion of the tub 14 to a pump 74. The pump 74 may direct liquid to a drain conduit 76, which may drain the liquid from the washing machine 10, or to a recirculation conduit 78, which may terminate at a recirculation inlet 80. The recirculation inlet 80 may direct the liquid from the recirculation conduit 78 into the drum 16. The recirculation inlet 80 may introduce the liquid into the drum 16 in any suitable manner, such as by spraying, dripping, or providing a steady flow of liquid. In this manner, liquid provided to the tub 14, with or without treating chemistry may be recirculated into the treating chamber 18 for treating the laundry within.

The liquid supply and/or recirculation and drain system may be provided with a heating system which may include one or more devices for heating laundry and/or liquid supplied to the tub 14, such as a steam generator 82 and/or a sump heater 84. Liquid from the household water supply 40 may be provided to the steam generator 82 through the inlet conduit 46 by controlling the first diverter mechanism 48 to direct the flow of liquid to a steam supply conduit 86. Steam generated by the steam generator 82 may be supplied to the tub 14 through a steam outlet conduit 87. The steam generator 82 may be any suitable type of steam generator such as a flow through steam generator or a tank-type steam generator. Alternatively, the sump heater 84 may be used to generate steam in place of or in addition to the steam generator 82. In addition or alternatively to generating steam, the steam generator 82 and/or sump heater 84 may be used to heat the laundry and/or liquid within the tub 14 as part of a cycle of operation.

Additionally, the liquid supply and recirculation and drain system may differ from the configuration shown in FIG. 1, such as by inclusion of other valves, conduits, treating chemistry dispensers, sensors, such as water level sensors and temperature sensors, and the like, to control the flow of liquid through the washing machine 10 and for the introduction of more than one type of treating chemistry.

The washing machine 10 also includes a drive system for rotating the drum 16 within the tub 14. The drive system may include a motor 88 drivingly coupled with the drum 16 for rotationally driving or rotating the drum 16. The motor 88 may be directly coupled with the drum 16 through a drive shaft 90 to rotate the drum 16 about a rotational axis during a cycle of operation. The motor 88 may be a brushless permanent magnet (BPM) motor having a stator 92 and a rotor 94. Alternately, the motor 88 may be coupled with the drum 16 through a belt and a drive shaft to rotate the drum 16, as is known in the art. Other motors, such as an induction motor or a permanent split capacitor (PSC) motor, may also be used. The motor 88 may rotationally drive the drum 16 including that the motor 88 may rotate the drum 16 at various speeds in either rotational direction. The motor 88 may be configured to rotatably drive the drum 16 in response to a motor control signal.

The washing machine 10 also includes a control system for controlling the operation of the washing machine 10 to implement one or more cycles of operation. The control system may include a controller 96 located within the cabinet 12 and a user interface 98 that is operably coupled with the controller 96. The user interface 98 may include one or more knobs, dials, switches, displays, touch screens and the like for communicating with the user, such as to receive input and provide output. The user may enter different types of information including, without limitation, cycle selection and cycle parameters, such as cycle options.

The controller 96 may include the machine controller and any additional controllers provided for controlling any of the components of the washing machine 10. For example, the controller 96 may include the machine controller and a motor controller. Many known types of controllers may be used for the controller 96. The specific type of controller is not germane to the invention. It is contemplated that the controller may be a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), may be used to control the various components.

Figure 2:
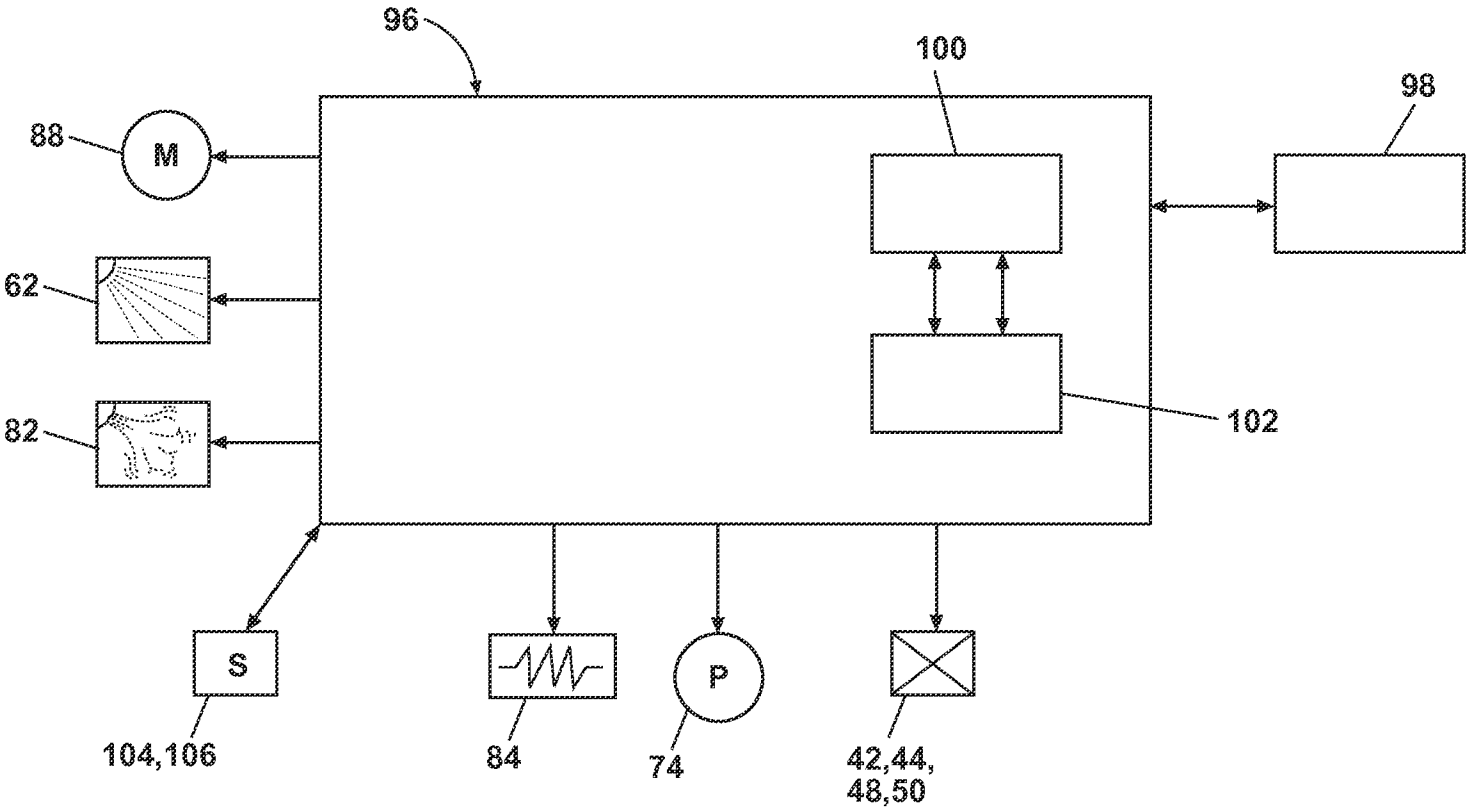
FIG. 2 is a schematic of a control system of the laundry treating appliance of FIG. 1.

As illustrated in FIG. 2, the controller 96 may be provided with a memory 100 and a central processing unit (CPU) 102. The memory 100 may be used for storing the control software that may be executed by the CPU 102 in completing a cycle of operation using the washing machine 10 and any additional software. Examples, without limitation, of cycles of operation include: wash, heavy duty wash, delicate wash, quick wash, pre-wash, refresh, rinse only, and timed wash. The memory 100 may also be used to store information, such as a database or table, and to store data received from one or more components of the washing machine 10 that may be communicably coupled with the controller 96. The database or table may be used to store the various operating parameters for the one or more cycles of operation, including factory default values for the operating parameters and any adjustments to them by the control system or by user input.

The controller 96 may be operably coupled with one or more components of the washing machine 10 for communicating with and controlling the operation of the component to complete a cycle of operation. For example, the controller 96 may be operably coupled with the motor 88, the pump 74, the dispenser 62, the steam generator 82 and the sump heater 84 to control the operation of these and other components to implement one or more of the cycles of operation.

The controller 96 may also be coupled with one or more sensors 104 provided in one or more of the systems of the washing machine 10 to receive input from the sensors, which are known in the art and not shown for simplicity. Non-limiting examples of sensors 104 that may be communicably coupled with the controller 96 include: a treating chamber temperature sensor, a moisture sensor, a weight sensor, a chemical sensor, a position sensor, an acceleration sensor, a speed sensor, an orientation sensor, an imbalance sensor, a load size sensor, and an inertia sensor, which may be used to determine a variety of system and laundry characteristics.

In one example, a motor sensor 106 may also be included in the washing machine 10 and may provide an output or signal related to the motor 88. For example, the motor sensor 106 may be a motor torque sensor; the motor torque may be a function of the inertia of the rotating drum 16 and the laundry load. By way of additional example, the motor sensor 106 may be a voltage sensor. Furthermore, the motor sensor 106 may be any suitable sensor, such as a voltage or current sensor, for outputting a current or voltage signal indicative of the current or voltage supplied to the motor 88, which may also be used to determine the torque applied by the motor 88. The motor sensor 106 may also include a motor controller or similar data output on the motor 88 that provides data communication with the motor 88 and outputs motor characteristic information, generally in the form of an analog or digital signal, to the controller 96. The controller 96 may use the motor characteristic information to determine the torque applied by the motor 88 or a voltage value using software that may be stored in the controller memory 100. Additionally, the motor sensor 106 may be a physical sensor or may be integrated with the motor and combined with the capability of the controller 96, or may function as a sensor. For example, motor characteristics, such as speed, current, voltage, torque etc., may be processed such that the data provides information in the same manner as a separate physical sensor. In contemporary motors, the motors often have their own controller that outputs data for such information.

It has been determined that by monitoring a load inertia while wetting the laundry load an accurate saturation level of the laundry may be determined and the supply of liquid to the laundry may be accurately controlled based thereon. During operation, the controller 96 may be configured to supply liquid from the liquid supply system to wet a laundry load located within the drum 16 while repeatedly determining a load inertia during the wetting the laundry load. It will be understood that repeatedly determining a load inertia may include continuously determining a load inertia. It is contemplated that the controller 96 may provide a motor control signal to the motor 88 to rotate the drum 16, that the motor sensor 106 may provide a suitable signal such as a motor torque signal or a voltage signal to the controller 96, and that the controller 96 may determine the load inertia from the received signal. It will be understood that the inertia within the system may be determined from the torque necessary to rotate the drum 16. Generally the motor torque for rotating the drum 16 with the laundry load may be represented in the following way:

$$\tau = J^*\dot{\omega} + \beta^*\omega + C \tag{1}$$

where, $\tau$=torque, J=inertia, $\dot{\omega}$=acceleration, $\omega$=rotational speed, B=viscous damping coefficient, and C=coulomb friction. The inertia may be determined in any suitable manner including by calculation or estimation. For example, it is contemplated that a mathematical model of the washer may be used to decompose the torque into contributions from acceleration, friction, and unbalance. A widely-known algorithm such as recursive least squares may be used to estimate the parameters in such a model. It will be understood that the controller 96 may repeatedly determine the load inertia in any suitable manner. The controller 96 may then determine a rate of change of the repeatedly determined load inertia. When the determined rate of change satisfies a predetermined threshold, which may be stored in the memory 100 of the controller 96, the controller 96 may stop the supply of liquid. Inertia may be determined in a variety of ways, additional description of methods for determining inertia may be found in U.S. application Ser. No. 13/965,326, filed Aug. 13, 2013, entitled Laundry Treating Appliance and Method of Predicting Mechanical Degradation in a Laundry Treating Appliance and U.S. application Ser. No. 13/469, 116, filed May 11, 2012, entitled Continuous High Speed Inertia Detection, whose descriptions are incorporated by reference herein.

Figure 3:
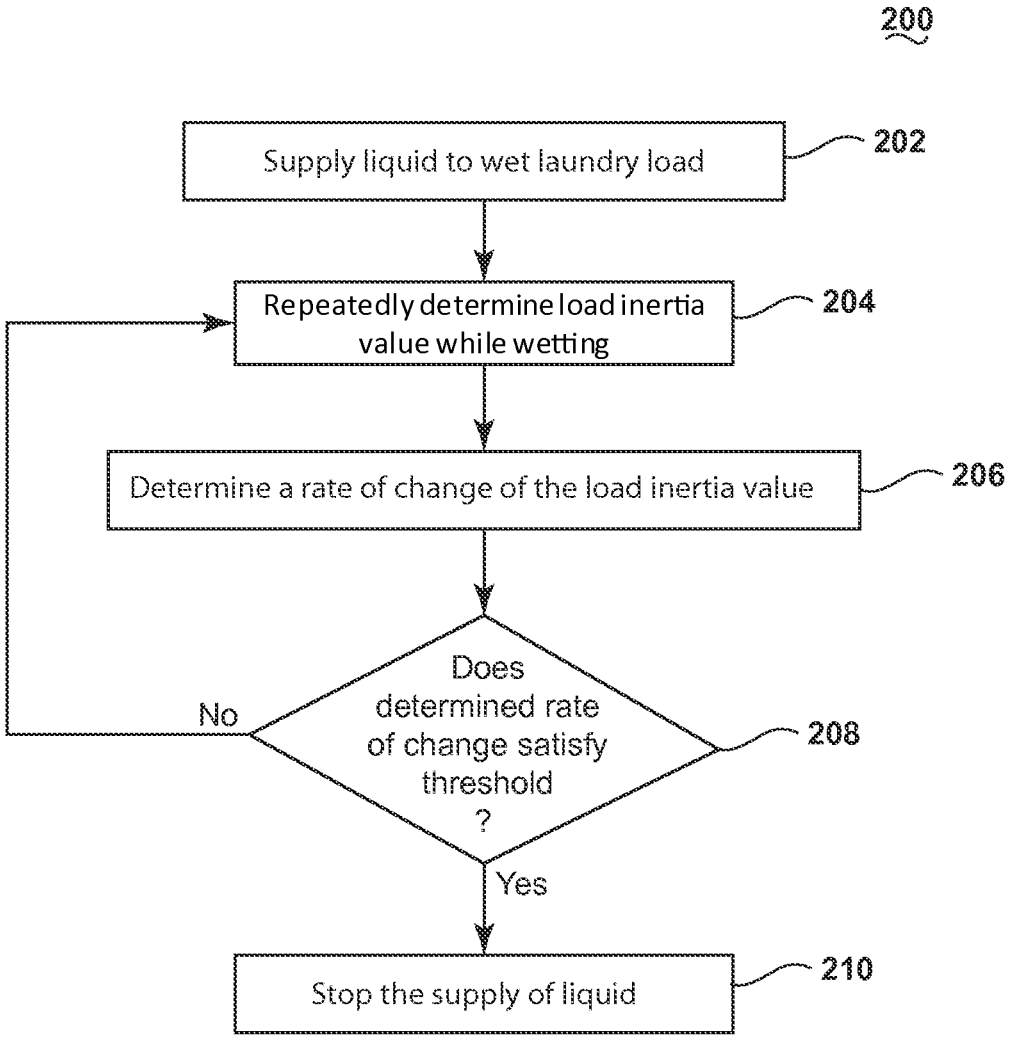
FIG. 3 is a flow chart illustrating a method of filling the laundry treating appliance according to an embodiment of the invention.

Referring now to FIG. 3, a flow chart of a method 200 for filling a laundry treating appliance, such as the washing machine 10, is illustrated. The sequence of steps depicted for this method is for illustrative purposes only, and is not meant to limit the method in any way as it is understood that the steps may proceed in a different logical order or additional or intervening steps may be included without detracting from the invention. The method 200 may be implemented in any suitable manner, such as automatically or manually, as a stand-alone phase or cycle of operation or as a phase of an operation cycle of the washing machine 10. The method 200 assumes that a user has provided a load of laundry within the drum 16.

The method 200 begins at 202 with supplying liquid to wet the laundry load located within the drum 16. For example, in the washing machine 10, the controller may control the valve 42 and/or the valve 44 as well as the first and second diverter mechanisms 48 and 50 to supply liquid to the tub 14 through the spray nozzle 56 and/or the dispensing nozzle 66. In this manner, water from the household water supply 40 may be supplied directly to the tub 14. The supplying of the liquid at 202 may be either continuous or intermittent.

It is contemplated that during at least a portion of the supplying of liquid at 202 that the controller 96 may rotate the drum 16 through operation of the motor 88. This may include that the drum 16 is rotated during the entire supply of liquid at 202. This may alternatively include that the drum 16 is rotated during intermittent portions between when liquid is supplied at 202. This may also include that the drum 16 is rotated while liquid is supplied intermittently. The drum 16 may be rotated at any suitable rotational speed including that the speed of the drum 16 may be ramped up and/or that the drum 16 may be rotated at a predetermined rotational speed or within a range of predetermined speeds. For example, the drum 16 may be rotated by the motor 88 at a non-satellizing speed such that the laundry load tumbles and/or the drum 16 may be rotated by the motor 88 at a satellizing speed, which may include spinning the drum 16 at a great enough velocity to have a 1G or greater centrifugal force at the inner surface of the drum. Such a satellizing speed may be a predetermined speed or may be a speed at which the controller 96 determines the laundry may be satellized. Furthermore, it is contemplated that rotation of the drum 16 may include either intermittent rotating or continuous rotating.

At 204, load inertia values may be repeatedly determined by the controller 96 while the laundry load is being wet to define a set of load inertia values. Determining the load inertia values may include estimating the load inertia values and/or calculating the load inertia values. For example, the load inertia values may be an indirect measurement indicative of the inertia instead of an actual inertia measurement or calculation. For example, a voltage value or a torque value may be considered an indirect measurement that may be indicative of the inertia. It is contemplated that such repeated determining by the controller 96 may be either continuous or intermittent. Regardless of whether the determinations are continuous or intermittent, it is contemplated that any number of inertia value determinations may be made.

In the case where the drum 16 is rotated during the supply of liquid, the load inertia values may be determined during the rotating of the drum 16. By way of non-limiting example, while the drum 16 is being rotated, a torque signal or voltage signal for the motor 88 may be received by the controller 96 and the controller 96 may repeatedly determine over time load inertia values. For example, repeatedly determining the load inertia values may include sampling the load inertia of the rotating drum at a predetermined sample rate.

The controller 96 may then determine a rate of change of the load inertia values at 206. Determining a rate of change of the load inertia may include determining a rate of increase and/or a rate of decrease. By way of non-limiting example, determining the rate of increase or decrease of the load inertia values may include determining a slope of the repeatedly determined load inertia values with respect to time. It is contemplated that the rate of change may be determined from specific determined inertia values and/or extrapolated inertia values. It is also contemplated that the rate of change may be determined from a plot of smoothed inertia values.

At 208, the controller 96 may determine if the rate of change satisfies a predetermined threshold. The term "satisfies" the predetermined threshold is used herein to mean that the rate of change satisfies the predetermined threshold, such as being equal to, less than, or greater than the threshold value. It will be understood that such a determination may easily be altered to be satisfied by a positive/negative comparison or a true/false comparison. For example, a less than threshold value can easily be satisfied by applying a greater than test when the data is numerically inverted. In implementation, the predetermined threshold and comparisons may be converted to an algorithm to determine the rate of change and determine when the rate of change satisfies the predetermined threshold. Including that for a determined rate of increase, the algorithm may determine when the rate of increase begins to level. Such algorithms may be converted to a computer program including a set of executable instructions, which may be executed by the controller 96. In the instance where determining the rate of increase includes determining a slope of the repeatedly determined load inertia values, the rate of increase may satisfy the predetermined threshold when the slope is below the predetermined threshold. Thus, the controller 96 may determine if the rate of increase is decreasing and/or the controller 96 may determine if the rate of increase is at a suitable level.

Regardless of how the rate of change is determined, if the predetermined threshold is satisfied, then the supply of liquid may be stopped by the controller 96 at 210. If the predetermined threshold is not satisfied, then the method continues to repeatedly determine inertia values at 204, determine a rate of change of the values at 206, and determines if the threshold has been satisfied at 208 all while liquid is being supplied to the drum 16.

In this manner, the controller 96 may control the supply of liquid to the drum 16 based on real-time determinations of inertia values. For example, as the liquid is absorbed in the laundry load, the determined inertia values will increase and once the laundry load begins to saturate with liquid, the slope of the inertia over time will begin to level off. When the load inertia is no longer increasing, the controller 96 may determine that the load is saturated and the liquid supply may be shut off. The rate of increase of the determined inertia values need not be zero to indicate full saturation. Further, it is contemplated that in an effort to save liquid, when the rate of increase begins to trend towards zero, the liquid supply may be stopped such that any lag associated with the liquid fill does not result in over-wetting the load. In the instance where determining the rate of change includes determining a rate of decrease the controller 96 may determine if the decrease occurred when the rotation of the drum 16 was moved to a different speed above satellization, which may indicate saturation.

Figure 4:
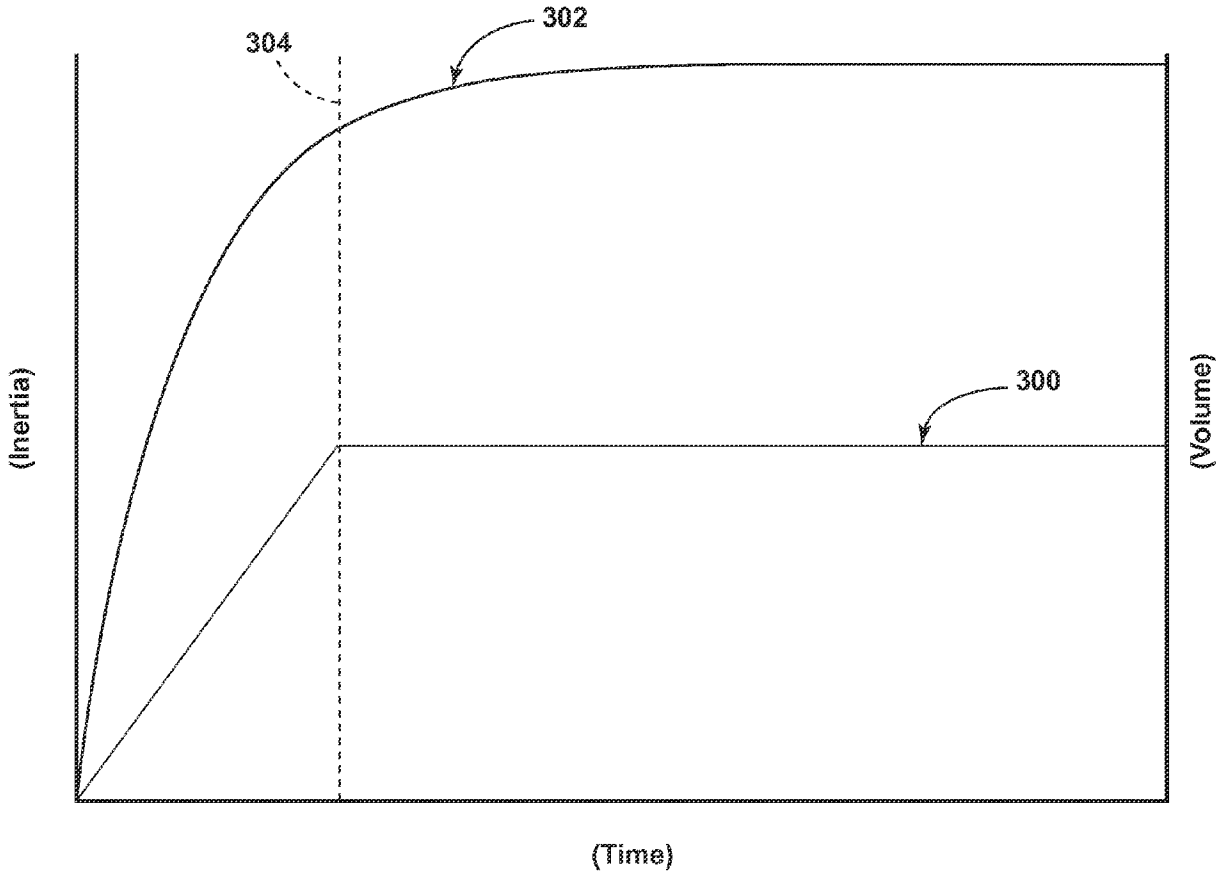
FIG. 4 is an exemplary plot illustrating an inertia determination and filling that may be achieved through embodiments of the invention.

For example, FIG. 4 illustrates one exemplary liquid supply that may be achieved based on an embodiment of the invention. A first plot 300 illustrates a plot of a liquid volume within the drum 16 and a second plot 302 illustrates a plot of inertia values. It will be understood that the determined inertia values need not be continuous and that discrete points may be used to form the second plot 302 including that the data may be smoothed to define such a second plot 302. At 304, when the rate of increase of the inertia values begins to decrease or begins to level off such that a predetermined threshold is satisfied, the liquid supply to the drum may be stopped. It is contemplated that the liquid volume supplied to the drum may remain constant while the laundry continues to become further saturated with liquid, which may occur for a variety of reasons including fabric type and contact with the liquid. Further, the controller 96 may make a prediction of the saturation based on the knee or bend in the second plot 302. In this manner, the controller 96 may stop the supply of liquid based on a specific rate of increase. This may further allow for a savings in liquid while still providing enough liquid to properly wash the laundry load.

It will be understood that the method 200 may be flexible and that the method 200 illustrated is merely for illustrative purposes. For example, while portions of the method and description thus far have been specific to a washing machine it will be understood that embodiments of the invention may be utilized with any suitable laundry treating appliance. Further, it is also contemplated the supplied liquid may be recirculated through the treating chamber 18 while the repeated inertia determinations are being made and/or while the drum 16 is being rotated to aid in wetting the laundry load within the drum 16. It is also contemplated that an initial dry inertia value of the dry laundry load within the drum 16 may be determined before the supply of liquid begins. Such a dry inertia value may be determined by one of estimation or calculation. Further, an initial amount of liquid from the liquid supply system may be supplied to the laundry load based on the determined load inertia of the dry load. Further still, it is contemplated that the drum 16 may be rotated in any suitable manner during the supplying of liquid and determinations, including that the drum 16 may be rotated so the laundry is not satellized to better wet the laundry and then the drum 16 may be rotated at a satellizing speed such that an inertia determination may be made. Furthermore, it has been described above that the supplying, rotating, and determining of inertia values may all be done intermittently. By way of non-limiting example, such a method may include, that a predetermined amount of liquid may be supplied, the laundry may be tumbled during or after the supply of the predetermined amount, the laundry may then be satellized and an inertia determination may be made during the satellizing, next an additional predetermined amount of liquid may be supplied, the laundry may be tumbled, the laundry may be satellized, an inertia value may be determined, etc. The predetermined amounts of liquid supplied may vary based on the previously determined inertia values or rate of change of the determined inertia values. It is further contemplated that the initial dry inertia value may be used to prescribe a water fill amount without thereafter looking for a predetermined rate of change of inertia; however, this need not be the case.

The above described embodiments provided a variety of benefits including that the above described laundry treating appliance and methods improve the ability to accurately estimate the amount of liquid that should be added to wash the load without wasting liquid. Current laundry treating appliances use an analog pressure sensor (APS), which identifies when the liquid in the sump reaches a certain level; however, because there is a significant lag in the system, by the time the APS detects an acceptable liquid amount, too much liquid has already been added. Further, there is a lot of variation associated with the APS and as a result, the wetting of a load is not consistent run-to-run, even with the same load in the drum. The above described embodiments may provide a more accurate way to determine proper liquid usage with significantly less variation than contemporary fill methods. Furthermore, the above described embodiments may be used in conjunction with an APS signal to provide more accurate liquid supply.

To the extent not already described, the different features and structures of the various embodiments may be used in combination with each other as desired. That one feature may not be illustrated in all of the embodiments is not meant to be construed that it may not be, but is done for brevity of description. Thus, the various features of the different embodiments may be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of filling a laundry treating appliance with liquid where the laundry treating appliance includes a tub, a drum located within the tub and at least partially defining a treating chamber in which laundry may be received for treatment according to an automatic cycle of operation, and a liquid supply system for introducing liquid into one of the drum and tub, the method comprising:

supply liquid from the liquid supply system to wet a laundry load located within the drum;

repeatedly determine, by the controller, a load inertia value while wetting the laundry load to define a set of load inertia values;

determine, by the controller, a rate of change over time of the load inertia values; and stop the supply of liquid when the determined rate of change satisfies a predetermined threshold indicative of the laundry load being saturated.

2. The method of claim 1, further comprising rotating the drum during at least a portion of the supply of liquid.

3. The method of claim 2 wherein the rotating is one of intermittent rotating or continuous rotating.

4. The method of claim 2 wherein the load inertia values are determined during the rotating of the drum.

5. The method of claim 2 wherein the rotating the drum includes spinning the drum at a great enough velocity to have a 1G or greater centrifugal force at an inner surface of the drum.

6. The method of claim 2, further comprising recirculating the supplied liquid through the treating chamber while the drum is being rotated.

7. The method of claim 2 wherein the repeatedly determining the load inertia values comprises sampling the load inertia of the rotating drum at a predetermined sample rate.

8. The method of claim 1 wherein the repeatedly determining is one of continuous or intermittent.

9. The method of claim 1 wherein the determining the rate of change comprises determining a rate of increase of the load inertia values.

10. The method of claim 9 wherein the determining the rate of increase of the repeatedly determined load inertia values comprises determining a slope of the repeatedly determined load inertia values with respect to time.

11. The method of claim 10 wherein the determined rate of increase satisfies the predetermined threshold when the slope is below the predetermined threshold.

12. The method of claim 10 wherein the determined rate of increase satisfies the predetermined threshold when the slope trends towards zero.

13. The method of claim 1 wherein the supplying liquid is one of continuous or intermittent.

14. The method of claim 1 wherein the repeatedly determining the load inertia values comprises one of estimating the load inertia values or calculating the load inertia values.

15. The method of claim 1 wherein the load inertia values are an indirect measurement indicative of the inertia.

16. The method of claim wherein the indirect measurement is a voltage value.

17. The method of claim 1, further comprising determining a dry inertia value of a dry laundry load within the drum.

18. The method of claim 16, further comprising supplying an initial amount of liquid from the liquid supply system based on the determined load inertia of the dry load to wet the laundry load.

19. The method of claim 16 wherein the dry inertia value is determined by one of estimation or calculation.

* * * * *